US006720515B2

(12) United States Patent
Renz et al.

(10) Patent No.: US 6,720,515 B2
(45) Date of Patent: Apr. 13, 2004

(54) VACUUM INTERRUPTER WITH TWO CONTACT SYSTEMS

(75) Inventors: Roman Renz, Berlin (DE); Norbert Steinemer, Falkensee (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/258,181

(22) PCT Filed: Jun. 6, 2001

(86) PCT No.: PCT/DE01/02125

§ 371 (c)(1),
(2), (4) Date: Oct. 22, 2002

(87) PCT Pub. No.: WO01/99132

PCT Pub. Date: Dec. 27, 2001

(65) Prior Publication Data

US 2003/0094438 A1 May 22, 2003

(30) Foreign Application Priority Data

Jun. 23, 2000 (DE) ..... 100 30 670

(51) Int. Cl.[7] ..... H01H 33/66
(52) U.S. Cl. ..... 218/136; 218/118
(58) Field of Search ..... 218/118, 120, 218/134–136, 137–140, 147, 153, 123, 126, 154, 155

(56) References Cited

U.S. PATENT DOCUMENTS 3,792,214 A * 2/1974 Voshall ..... 218/136
4,107,496 A * 8/1978 Clason ..... 218/126
4,361,742 A * 11/1982 Kashiwagi et al. ..... 218/136

FOREIGN PATENT DOCUMENTS

| | | | |
|---|---|---|---|
| DE | 20 37 234 A1 | 2/1972 | |
| DE | 25 27 319 A1 | 1/1976 | |
| DE | 33 04 803 A1 | 8/1984 | |
| EP | 0 155 376 B1 | 9/1985 | |
| EP | 1 005 058 A2 | 5/2000 | |
| EP | 1005058 A2 * | 5/2000 | ..... H01H/33/66 |

* cited by examiner

*Primary Examiner*—Lincoln Donovan
*Assistant Examiner*—M. Fishman
(74) *Attorney, Agent, or Firm*—Morrison & Foerster LLP

(57) ABSTRACT

This invention relates to a novel vacuum interrupter. The aim of the invention is for said is for said interrupter to perform the functions switching, disconnection and earthing and to be economically producible. Said aim is achieved by means of a first contact system produced with radial- or axial-magnetic filed contacts, the movable contact of which is connected to the movable contact of a second contact system, comprising annular discs. The stationary contact of the second contact system forms an annular part of the housing to which two tubular insulators are connected. One of the insulators encloses both contact systems and is protected by a screen fixed to the movable contact piece, which separates the plasma physics of the both contact systems.

8 Claims, 2 Drawing Sheets

VACUUM INTERRUPTER WITH TWO CONTACT SYSTEMS

CLAIM FOR PRIORITY

This application claims priority to International Application No. PCT/DE01/02125 which was published in the German language on Dec. 27, 2001.

TECHNICAL FIELD OF THE INVENTION

The invention relates to the field of electrical switches, and is applicable to the design configuration of a vacuum interrupter in which, in order to carry out the functions of "switching", "disconnection" and "grounding", the housing contains three contacts and has a grounding connection, which is in the form of a metallic area of the housing.

BACKGROUND OF THE INVENTION

In a known vacuum interrupter of this type, the metallic part of the housing is formed from a cylinder in which insulators are inserted, which are in the form of annular disks at the ends. A current supply bolt of a first contact system, which is arranged concentrically with respect to the axis of the housing, passes axially through each of the two insulators, with the current supply bolt of the stationary contact of the first contact system being soldered to one of the insulators in a vacuum-tight manner. The current supply bolt of the moving contact of the first contact system is passed through a hole in the other insulator such that it can move. The rearward part of the moving contact of the first contact system at the same time forms the moving contact of a second contact system, which is arranged coaxially with respect to the first contact system and whose stationary contact is in the form of an annular disk and is connected in the edge area to the metallic part of the housing. A grounding contact is arranged at one of the ends of this housing. The first contact system also has an associated shield, which is in the form of a cylinder which is supported on the metallic cylinder via an annular insulating piece.

Furthermore, for medium-voltage switchgear assemblies, a switch disconnector is known in which at least two contact pairs are arranged in a common vacuum vessel, and in which the plasmas in the contact pairs are physically isolated from one another by special shields. For this purpose, two coaxial shielding cylinders, whose cylinder walls overlap in the axial direction, may be used for each contact pair. The shielding cylinders are in this case electrically conductively connected to a respective one of the contacts of the associated contact pair. Each contact pair may furthermore have an associated ground contact, to which the moving switching contact can be connected. In this case, the moving switching contact can be fixed in three switch positions.

SUMMARY OF THE INVENTION

According to an aspect of the invention, a design configuration which satisfies the practical requirements such as simple construction and cost-effective production is provided.

According to the invention, a first contact system has radial or axial magnetic field contact pieces and for the second contact system has contact pieces which are each arranged by a contact support and are in the form of annular disks. The contact support of one of the contact pieces, which is in the form of an annular disk, is arranged on the bottom face of the moving radial or axial magnetic field contact. The contact support of the other contact piece, which is in the form of an annular disk, forms the ground connection. Furthermore, the two insulators are tubular and are connected to one another at the ends with the interposition of the grounding connection, with one of the insulators surrounding the first contact system and essentially also the moving contact of the second contact system. Finally, the shield is in the form of a labyrinth shielding system in order to physically isolate plasma in the first contact system from plasma in the second contact system. The shielding system comprises a tube which surrounds the first contact system, and, together with the contact support, which is arranged on the moving contact, of the contact which is in the form of an annular disk, forms a cap.

With the vacuum interrupter configured in this way, normal components and normal manufacturing measures can generally be used for the construction and production of the vacuum interrupter, so that the vacuum interrupter can be produced economically. The use of magnetic field contact pieces and the configuration of the shield as provided in this case ensure the electrical performance of the interrupter.

The use of tubular insulators, in particular ceramic insulators, is normal per se for vacuum interrupters, as is the configuration of the contact pieces as radial or axial magnetic field contacts.

Since the second contact system need be designed only for the required make-proofing, a simple plate or annular disk geometry is sufficient for the corresponding contact pieces; a material based on copper/chromium is preferably used as the make-proof contact material. If necessary, for further design simplification, the contact support of the moving contact piece may be formed integrally with the tube which surrounds the first contact system. In this case, it is also possible for the contact support, with appropriate shaping, to at the same time form the moving contact piece, which is in the form of an annular disk. shield, it is recommended that the distance between the tube and the insulator which surrounds the contact system be chosen to be shorter than the distance between the tube and the first contact system.

BRIEF DESCRIPTION OF THE DRAWINGS

FIG. 1 shows a vacuum interrupter which, essentially, has a housing 10, a first contact system 22, a second contact system 25 and a shield 30.

Figure 1:
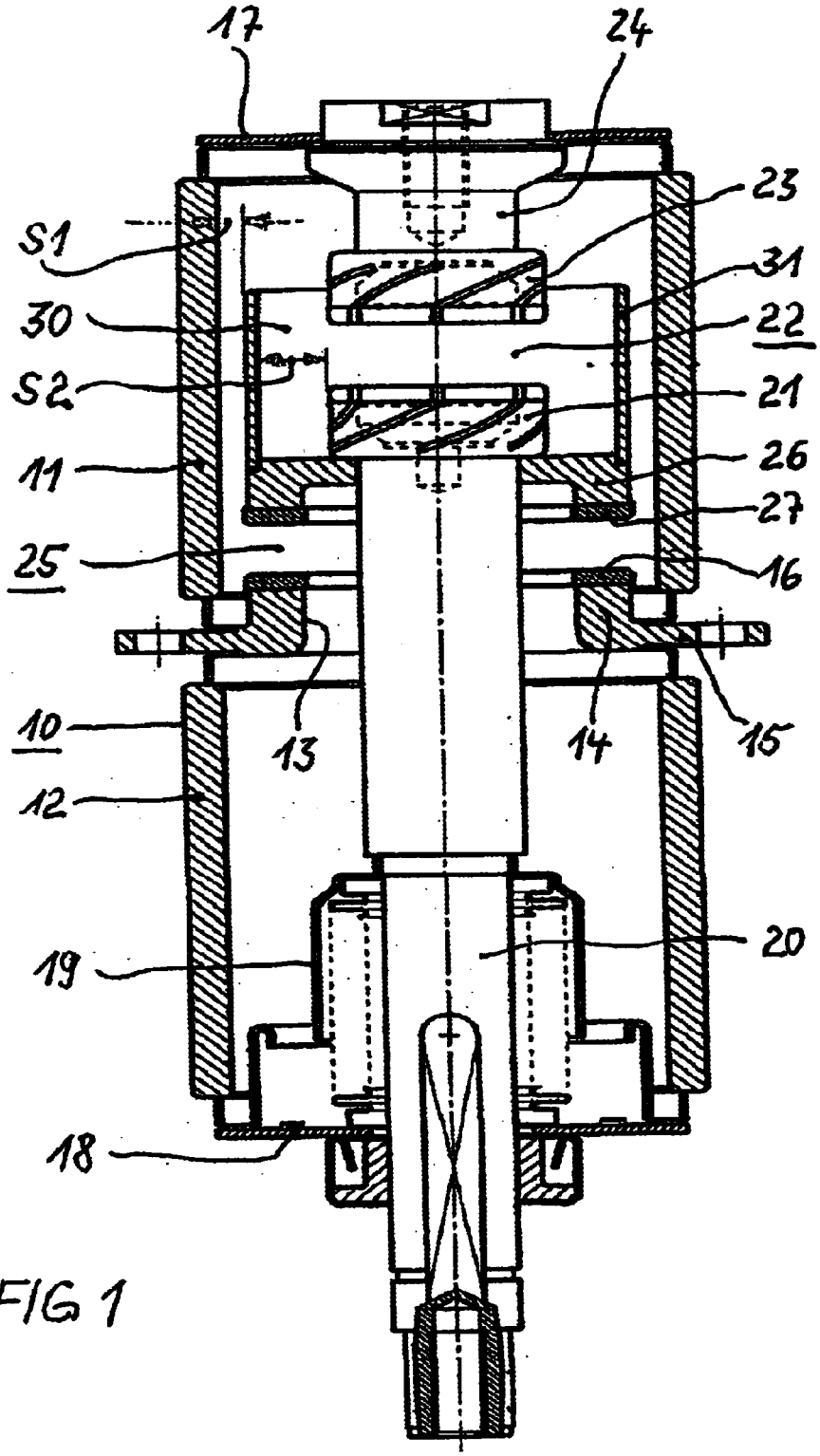
FIG. 1 shows a vacuum interrupter with a shield in two pieces.

The housing 10 is composed of insulating parts and metal parts. Two tubular ceramic insulators 11 and 12 are arranged coaxially with respect to one another and are connected to one another with the interposition of a metallic part 13. The metallic part 13 forms the grounding contact of the vacuum interrupter, and is for this purpose in the form of a short tubular piece 14, which is arranged concentrically with respect to the axis A of the housing, has thick walls and has a radially running connecting flange 15. The tubular piece 14 forms an annular contact support for a contact piece 16 which is in the form of an annular disk. Annular angle pieces, which are not shown in any more detail, are soldered on both sides to the connecting flange 15 and are used as connecting parts for connecting the metallic part 13 to the ceramic insulators 11 and 12 by means of cut soldering.

The housing 10 also has a metallic upper covering plate 17 and a metallic lower covering plate 18, which are each soldered by means of cut soldering to the ceramic insulator 11 or to the ceramic insulator 12. One of the ends of a bellows 19 is also soldered to the lower covering plate 18, and its other end is soldered to a current supply bolt 20.

The current supply bolt 20, which is passed through the lower covering plate 18 such that it can move, is fitted at its upper end with the moving contact piece 21 of the first contact system, which is provided for switching current and voltage. A stationary contact piece 23 is arranged coaxially with respect to the moving contact piece 21, and is mounted by means of a current supply bolt 24 on the upper covering plate 17.

The current supply bolt 20, which is passed through the metallic part 13 which forms the grounding contact, is also fitted with the moving contact of the second contact system 25. For this purpose, a flat, pot-like contact support 26 with thick walls is arranged on the rear face of the moving contact 21 and is fitted with a contact disk 27 in the form of an annular disk. The arrangement of the contact support 26 allows a shield, which comprises a tubular piece 31 connected to the contact support 26, to be associated with the first contact system. This results in a shielding system which covers the first contact system 22 like a cap. In this case, the distance S1 between the tubular piece 31 and the ceramic insulator 11 which surrounds the first contact system 22 and the second contact system 25 is chosen to be less than the distance S2 between the tube 31 and the contact system 22, thus forming a labyrinth shielding system in order to physically isolate plasma in the first contact system 22 from plasma in the second contact system 25.

The contacts 21 and 23 in the first contact system 22 are in the form of axial magnetic field contacts; the contacts in the second contact system are in the form of simple annular disks 16 and 27, and are composed of a copper-chromium material.

Figure 2:
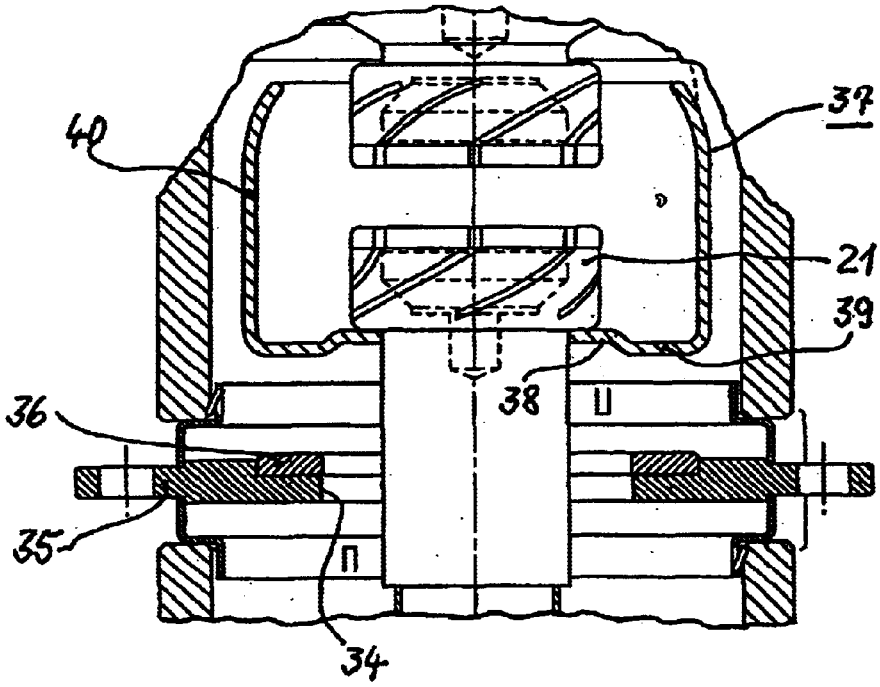
FIG. 2 shows a vacuum interrupter with an integral shield.

FIG. 2 shows a detail of a vacuum interrupter, which differs from that shown in FIG. 1 in the configuration of the second contact system and of the shield. In this case, the stationary contact, which forms the grounding connection 34, of the second contact system is in the form of an annular disk which is provided with a connecting flange 35 and to which a contact piece 36 in the form of an annular disk is fitted. A cap 37 which surrounds the first contact system is arranged on the rear face of the moving contact piece 21 of the first contact system, and its bottom area 38 is shaped so as to form an annular shoulder 39. This shoulder may itself form the moving contact of the second contact system, or may be fitted with a contact piece in the form of a circular ring, in a similar way to the grounding contact 34. In this exemplary embodiment, the bottom area 38 of the cap. 37 at the same time forms the contact support for the moving contact of the second contact system. The side wall 40 of the cap is cylindrical and, together with the bottom area 38, forms the shield.

What is claimed is:

1. A vacuum interrupter having three contacts, which are arranged in a cylindrical housing, for carrying out the functions of switching, disconnection and grounding, wherein the housing has a metallic area in the form of a grounding connection and two areas having insulators, a moving contact and a first stationary contact form a first contact system, and the moving contact and a second stationary contact, which is connected to the grounding contact, form a second contact system, the two contact systems are arranged coaxially with respect to one another and concentrically with respect to an axis of the housing, the first contact system is surrounded by a shield, wherein the first contact system has radial or axial magnetic field contact pieces, and the second contact system has contact pieces which are each arranged by a contact support and are in the form of annular disks, with the contact support of one of the annular contact pieces being arranged on the rear face of the moving radial or axial magnetic field contact, and the contact support of the other contact piece, which is the form of an annular disk, forming the grounding connection, the two insulators are tubular and are connected to one another at ends with the grounding connection interposed therebetween, one of the insulators surrounds the first contact system, and essentially also the moving contact of the second contact system, and the shield is in the form of a labyrinth shielding system in order to physically isolate plasma in the first contact system from plasma in the second contact system, which shielding system comprises a tube which surrounds the first contact system, and, together with the contact support, which is arranged on the moving contact, of the contact piece which is in the form of an annular disk, forms a cap.

2. The vacuum interrupter as claimed in claim 1, wherein the contact support of the moving contact piece, which is in the form of an annular disk, is in the form of a flat pot with thick walls.

3. The vacuum interrupter as claimed in claim 1, wherein the contact support of the moving contact piece, which is in the form of an annular disk, is formed integrally with the tube which surrounds the first contact system.

4. The vacuum interrupter as claimed in claim 3, wherein the contact support at the same time forms the contact piece which is in the form of an annular disk.

5. The vacuum interrupter as claimed in claim 1, wherein a distance between the tube and the insulator is less than the distance between the tube and the first contact system.

6. The vacuum interrupter as claimed in claim 1, wherein the contact support, which forms the grounding connection, of the second contact system is in the form of a piece of tubing which has thick walls and has a radially running flange.

7. The vacuum interrupter as claimed in claim 1, wherein the contact support which forms the grounding connection is in the form of an annular disk.

8. The vacuum interrupter as claimed in claim 1, wherein the contact pieces, which are in the form of annular disks, of the second contact system are composed of a copper-chromium material.

* * * * *